US005085380A

United States Patent [19]

Barton

[11] Patent Number: 5,085,380

[45] Date of Patent: Feb. 4, 1992

[54] PROJECTILE GUIDANCE

[75] Inventor: Arthur E. M. Barton, Bristol, United Kingdom

[73] Assignee: British Aerospace Public Limited Company, London, England

[21] Appl. No.: 246,140

[22] Filed: Sep. 6, 1988

[30] Foreign Application Priority Data

Sep. 10, 1987 [GB] United Kingdom ..... 8721291

[51] Int. Cl.[5] ..... F42B 10/64

[52] U.S. Cl. ..... 244/3.21; 244/324

[58] Field of Search ..... 244/3.21, 3.23, 3.24, 244/3.22, 3.26, 3.27, 3.28, 3.29

[56] References Cited

U.S. PATENT DOCUMENTS

| | | | |
|---|---|---|---|
| 3,880,383 | 4/1975 | Voss et al. | 244/3.27 |
| 4,373,688 | 2/1983 | Topliffe | 244/3.24 |
| 4,431,150 | 2/1984 | Epperson, Jr. | 244/3.21 |
| 4,600,167 | 7/1986 | Kastenhuber et al. | 244/3.26 |
| 4,890,554 | 1/1990 | Schleimann-Jensen | 244/3.21 |

FOREIGN PATENT DOCUMENTS

| | | | |
|---|---|---|---|
| 1141537 | 12/1962 | Fed. Rep. of Germany | 244/3.21 |

*Primary Examiner*—Michael J. Carone
*Attorney, Agent, or Firm*—Cushman, Darby & Cushman

[57] ABSTRACT

This invention relates to a projectile having moving airfoils for guidance and to an actuator for moving the airfoils in order to provide a low cost actuator for use in small size projectiles.

3 Claims, 1 Drawing Sheet

PROJECTILE GUIDANCE

Figure 1:
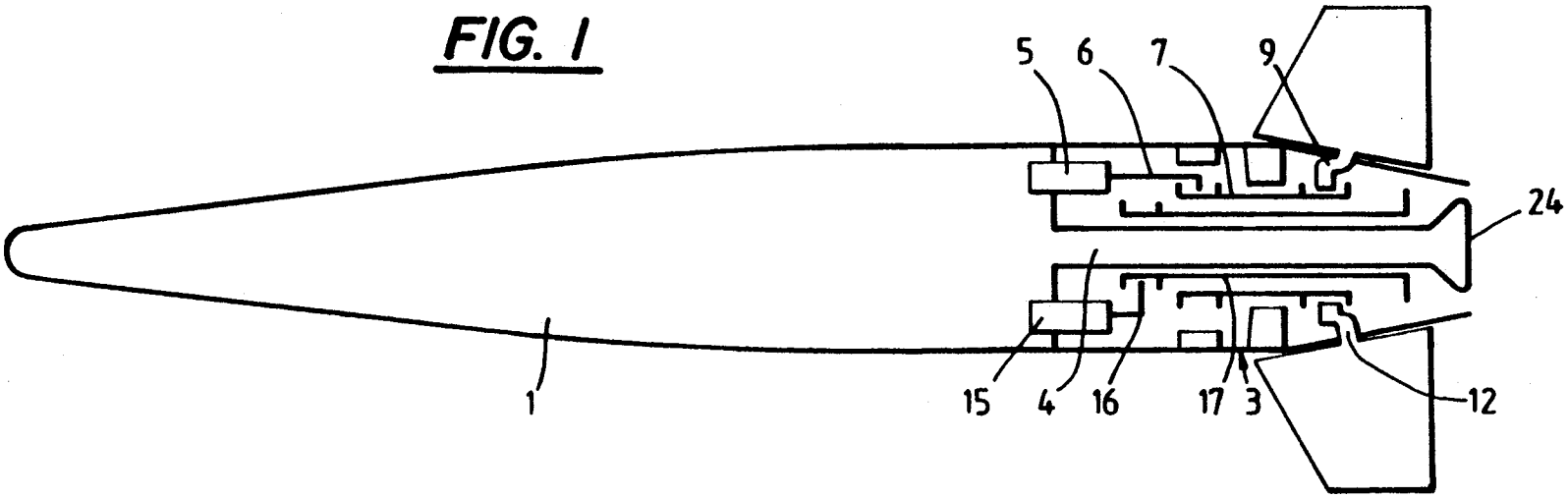

This invention relates to a projectile having moving airfoils for guidance, and to an actuator for moving the airfoils. Projectile here means a guided rocket propelled missile, a gun launched guided projectile or the like.

The object of the invention is to provide a low cost actuator for use in small size projectiles particularly those of which the body or a substantial part thereof has to rotate and considerable lateral acceleration is required.

According to the present invention, there is provided an airfoil actuating system for a projectile comprising a tubular member mounted in the projectile for fore and aft movement with respect to the projectile, a crank member connected between an airfoil and the tubular member for said fore and aft movement of the tubular member to turn the airfoil, and a push-pull actuator for driving said fore and aft movement of the tubular member.

The proposed actuation system is intended to be applicable to guided rockets and projectiles, spun up, or non-spinning, with roll ailerons and pitch elevators either at the front or the rear. In the event that part of the body is intended to spin, the ailerons and elevators are mounted on a separate nose or tail section which is attached to the main body by a bearing.

A projectile having a spinning main body, roll position controlled rear body and tail controls is shown in the drawing. It embodies the principle of two concentric push-pull tubes to transmit the control actuator forces to the ailerons and elevators on the rear body.

FIG. 1 schematically represents a projectile according to this invention, and

Figure 2:
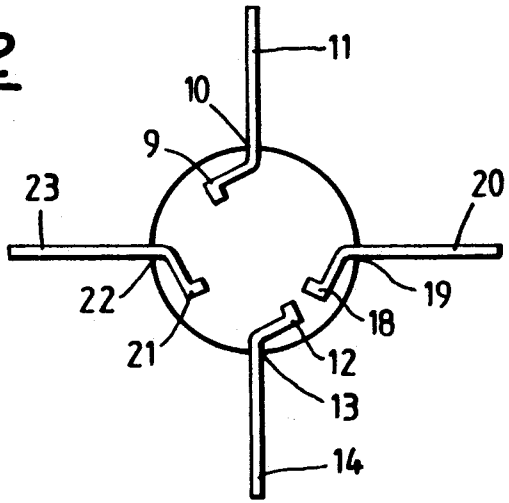

FIG. 2 is a schematic rear view with parts removed.

In this embodiment of the two concentric push-pull tube principle the in flight operation is as follows:

The front body 1 is spinning and the roll position of the rear body 3 is sensed from the front body. Two push-pull actuators 5 and 15 are fixed to the front body—each is shown in its neutral position. On command from the guidance computer, the hooked spindle 6 of the roll actuator withdraws or extends so as to turn the ailerons 11 and 14 in opposite directions until the rear body is positioned in space at 90° to the required pitch direction. The hooked spindle 6 is engaged in an annular channel at the front end of a push-pull tube 7 while cranks 9 and 12 connected to ailerons 11 and 14 are engaged in an annular channel at the rear of this tube. Thus movement of spindle 6 is transmitted to tube

7 and thence to ailerons 11 and 14. Ailerons 11 and 14 move relative to respective bearings 10 and 13.

The pitch force is then applied to the elevators from the pitch actuator 15 through a hooked spindle 16 and push-pull tube 17 to the cranks 18 and 21 and thence to the elevators 20 and 23. Like tube 7, tube 17 has annular channels at front and rear in which the hooks of spindle 16 and the cranks 18 and 21 are engaged. The channels on the tubes enable the fore and aft movement to be transmitted while permitting relative rotation of tubes, actuators, and cranks. Elevators 20 and 23 move relative to respective bearings 19 and 22.

A central body part 4 extends back from the front body within the rear body 3. The central part 4 provides support for rearward looking sensors, or base bleed, or rocket nozzle 24.

There are other possible configurations of the aileron(s) and elevators. The assembly may be used for canard control, and it may incorporate folding ailerons and elevators.

I claim:

1. Airfoil actuating system for a projectile comprising:

a tubular member mounted in the projectile for fore and aft movement with respect to the projectile, a crank member coupled between a projectile airfoil and the tubular member for said fore and aft movement of the tubular member to turn the airfoil, and a push-pull actuator for driving said fore and aft movement of the tubular member, wherein a portion of at least one of said push-pull actuator and said crank member is engaged in an annular channel formed in the tubular member so that the tubular member and said portion can rotate relative to one another.

2. A system according to claim 1 including a further push-pull actuator engaged with a further tubular member which is in turn engaged with a further airfoil via a further crank member, the two tubular members lying one within the other.

3. Airfoil actuating system for a projectile comprising:

a tubular member mounted in the projectile for fore and aft movement with respect to the projectile, a crank member coupled between a projectile airfoil and the tubular member for said fore and aft movement of the tubular member to turn the airfoil, a push-pull actuator for driving said fore and aft movement of the tubular member, and a further push-pull actuator engaged with a further tubular member which is in turn engaged with a further airfoil via a further crank member, the two tubular members lying one within the other.

* * * * *